US006128168A

United States Patent [19]

Arnold et al.

[11] Patent Number: 6,128,168

[45] **Date of Patent: *Oct. 3, 2000**

[54] CIRCUIT BREAKER WITH IMPROVED ARC INTERRUPTION FUNCTION

[75] Inventors: David Arnold, Chester, Conn.; Anil R. Duggal; Lionel M. Levinson, both of Niskayuna, N.Y.; Harold Jay Patchen, Burnt Hills, N.Y.; Larry Neil Lewis, Scotia, N.Y.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/006,790

[22] Filed: Jan. 14, 1998

[51] Int. Cl.[7] ..... H01H 9/30

[52] U.S. Cl. ..... 361/13; 361/10; 361/58; 361/106; 338/21; 338/22 R

[58] Field of Search ..... 361/2–13, 58, 361/102, 106; 338/20, 21, 22 R

[56] References Cited

U.S. PATENT DOCUMENTS

| | | | |
|---|---|---|---|
| 2,933,574 | 4/1960 | Frink | 200/144 |
| 2,978,665 | 4/1961 | Vernet et al. | 338/223 |
| 3,046,371 | 7/1962 | Jencks | 200/88 |

(List continued on next page.)

FOREIGN PATENT DOCUMENTS

| | | |
|---|---|---|
| 2036032 | 8/1981 | Canada . |
| 0 026 456 | 4/1981 | European Pat. Off. . |
| 0 087 884 | 9/1983 | European Pat. Off. . |
| 0 240 447 | 10/1987 | European Pat. Off. . |
| 0 363 746 | 4/1990 | European Pat. Off. . |
| 0 487 920 | 6/1992 | European Pat. Off. . |
| 0 576 836 | 1/1994 | European Pat. Off. . |
| 0 640 995 | 3/1995 | European Pat. Off. . |
| 0 713 227 | 5/1996 | European Pat. Off. . |
| 0 747 910 | 12/1996 | European Pat. Off. . |
| 0 773 562 | 5/1997 | European Pat. Off. . |
| 0 809 267 | 11/1997 | European Pat. Off. . |
| 0 762 439 | 12/1997 | European Pat. Off. . |
| 42 28 297 | 3/1994 | Germany . |
| 43 30 607 | 3/1995 | Germany . |
| 15 70 138 | 6/1980 | United Kingdom . |
| WO 91/12643 | 8/1991 | WIPO . |
| WO 91/13454 | 9/1991 | WIPO . |
| WO 91/19297 | 12/1991 | WIPO . |
| WO 93/07667 | 4/1993 | WIPO . |
| WO 93/21677 | 10/1993 | WIPO . |
| WO 94/10734 | 5/1994 | WIPO . |
| WO 95/03619 | 2/1995 | WIPO . |
| WO 95/19297 | 7/1995 | WIPO . |
| WO 95/20235 | 7/1995 | WIPO . |
| WO 95/34913 | 12/1995 | WIPO . |
| WO 97/49102 | 12/1997 | WIPO . |

OTHER PUBLICATIONS

Glass Transition Temperature as a Guide to Selection of Polymers Suitable for PTC Materials, J. Meyer, Polymer Engineering and Science, Nov. 1973, vol. 13, No. 6, pp. 462–468.

Stability of Polymer Composites as Positive–Temperature–Coefficient Resistors, J. Meyer, Polymer Engineering and Science, Oct. 1974, vol. 14, No. 10, pp. 706–716.

*Primary Examiner*—Michael J. Sherry

*Attorney, Agent, or Firm*—Cantor Colburn LLP; Carl B. Horton

[57] ABSTRACT

A fault current interrupter is provided by the parallel combination of a polymer current limiter and a voltage dependent resistor connected across a pair of separable contacts to permit the interruption of current without the occurrence of arcing between the contacts when the contacts first become separated. The polymer current limiter is selected to have a relatively low resistance at quiescent operating currents and a substantially higher resistance at short circuit overcurrents. This allows the current to transfer away from the contacts through the polymer current limiter until the voltage across the voltage dependent resistor causes the voltage dependent resistor to become conductive and thereby transfer the current away from the polymer current limiter.

48 Claims, 1 Drawing Sheet

U.S. PATENT DOCUMENTS

| | | | |
|---|---|---|---|
| 3,226,600 | 12/1965 | Zielasek | 315/209 |
| 3,243,753 | 3/1966 | Kohler | 338/31 |
| 3,401,363 | 9/1968 | Vyskocil et al. | 335/17 |
| 3,443,258 | 5/1969 | Dunham et al. | 337/79 |
| 3,488,761 | 1/1970 | Ito et al. | 337/221 |
| 3,548,358 | 12/1970 | Klein | 337/83 |
| 3,596,218 | 7/1971 | Layton | 335/17 |
| 3,596,219 | 7/1971 | Erickson | 335/17 |
| 3,632,926 | 1/1972 | Heft | 200/144 C |
| 3,648,002 | 3/1972 | Du Rocher | 200/166 C |
| 3,673,121 | 6/1972 | Meyer | 252/511 |
| 3,914,727 | 10/1975 | Fabricius | 338/22 R |
| 3,978,300 | 8/1976 | Slade | 200/147 R |
| 4,001,742 | 1/1977 | Jencks et al. | 335/173 |
| 4,017,715 | 4/1977 | Whitney et al. | 219/553 |
| 4,019,097 | 4/1977 | Miller et al. | 361/93 |
| 4,077,025 | 2/1978 | Slade et al. | 335/16 |
| 4,101,862 | 7/1978 | Takagi et al. | 338/23 |
| 4,107,640 | 8/1978 | Asano et al. | 338/23 |
| 4,115,829 | 9/1978 | Howell | 361/42 |
| 4,132,968 | 1/1979 | Lang | 335/16 |
| 4,164,772 | 8/1979 | Hingorani | 361/58 |
| 4,165,502 | 8/1979 | Andersen | 335/39 |
| 4,178,618 | 12/1979 | Khalid | 361/58 |
| 4,208,690 | 6/1980 | McGinnis et al. | 361/48 |
| 4,237,441 | 12/1980 | van Konynenburg et al. | 338/22 R |
| 4,292,261 | 9/1981 | Kotani et al. | 264/24 |
| 4,304,987 | 12/1981 | van Konynenburg | 219/553 |
| 4,317,027 | 2/1982 | Middleman et al. | 219/553 |
| 4,329,669 | 5/1982 | Krasser et al. | 335/20 |
| 4,329,726 | 5/1982 | Middleman et al. | 361/58 |
| 4,333,861 | 6/1982 | Aoki et al. | 252/518 |
| 4,345,288 | 8/1982 | Kampf et al. | 361/31 |
| 4,347,539 | 8/1982 | Peterson et al. | 361/16 |
| 4,374,049 | 2/1983 | Ellis et al. | 252/519 |
| 4,375,021 | 2/1983 | Pardini et al. | 200/147 B |
| 4,413,301 | 11/1983 | Middleman et al. | 361/106 |
| 4,458,283 | 7/1984 | Iida | 361/76 |
| 4,459,495 | 7/1984 | Gheewala | 307/306 |
| 4,466,071 | 8/1984 | Russell, Jr. | 364/492 |
| 4,485,283 | 11/1984 | Hurtle | 200/144 R |
| 4,511,772 | 4/1985 | Link et al. | 200/144 R |
| 4,513,268 | 4/1985 | Seymour et al. | 335/35 |
| 4,513,342 | 4/1985 | Rocha | 361/94 |
| 4,552,018 | 11/1985 | Legatti et al. | 73/431 |
| 4,573,259 | 3/1986 | Seymour et al. | 29/602 R |
| 4,583,146 | 4/1986 | Howell | 361/13 |
| 4,589,052 | 5/1986 | Dougherty | 361/94 |
| 4,598,183 | 7/1986 | Gardner et al. | 200/50 A |
| 4,641,216 | 2/1987 | Morris et al. | 361/45 |
| 4,641,217 | 2/1987 | Morris et al. | 361/45 |
| 4,642,136 | 2/1987 | Fukushima et al. | 75/234 |
| 4,645,889 | 2/1987 | Howell | 200/144 AP |
| 4,649,455 | 3/1987 | Scott | 361/93 |
| 4,652,975 | 3/1987 | Scott | 361/404 |
| 4,658,322 | 4/1987 | Rivera | 361/37 |
| 4,667,263 | 5/1987 | Morris et al. | 361/42 |
| 4,672,501 | 6/1987 | Bilac et al. | 361/96 |
| 4,677,266 | 6/1987 | Belbel et al. | 200/151 |
| 4,685,025 | 8/1987 | Carlomagno | 361/106 |
| 4,686,600 | 8/1987 | Morris et al. | 361/42 |
| 4,688,134 | 8/1987 | Freeman et al. | 361/45 |
| 4,702,002 | 10/1987 | Morris et al. | 29/837 |
| 4,746,896 | 5/1988 | Mcquaid et al. | 338/314 |
| 4,749,829 | 6/1988 | Ikeda et al. | 200/144 AP |
| 4,752,660 | 6/1988 | Yokoyama et al. | 200/151 |
| 4,754,247 | 6/1988 | Raymont et al. | 335/202 |
| 4,764,650 | 8/1988 | Bur et al. | 200/153 G |
| 4,780,598 | 10/1988 | Fahey et al. | 219/511 |
| 4,782,583 | 11/1988 | Castonguay et al. | 29/622 |
| 4,789,848 | 12/1988 | Castonguay et al. | 335/167 |
| 4,806,893 | 2/1989 | Castonguay et al. | 335/20 |
| 4,816,958 | 3/1989 | Belbel et al. | 361/93 |
| 4,847,850 | 7/1989 | Kafka et al. | 372/71 |
| 4,878,143 | 10/1989 | Kalal et al. | 361/94 |
| 4,878,144 | 10/1989 | Nebon | 361/96 |
| 4,884,164 | 11/1989 | Dziura et al. | 361/97 |
| 4,890,186 | 12/1989 | Matsubara et al. | 361/103 |
| 4,931,894 | 6/1990 | Legatti | 361/45 |
| 4,936,894 | 6/1990 | Larson et al. | 70/298 |
| 4,937,696 | 6/1990 | Yoshino et al. | 361/11 |
| 4,949,060 | 8/1990 | Mikulecky | 337/4 |
| 4,963,849 | 10/1990 | Kowalczyk et al. | 335/201 |
| 4,965,544 | 10/1990 | Kelaita , Jr. et al. | 335/202 |
| 4,967,304 | 10/1990 | Dougherty | 361/31 |
| 4,970,481 | 11/1990 | Arnold et al. | 335/6 |
| 5,057,674 | 10/1991 | Smith-Johannsen | 219/553 |
| 5,068,634 | 11/1991 | Shrier | 338/21 |
| 5,089,796 | 2/1992 | Glennon et al. | 335/172 |
| 5,105,178 | 4/1992 | Krumme | 337/140 |
| 5,121,282 | 6/1992 | White | 361/42 |
| 5,166,658 | 11/1992 | Fang et al. | 338/23 |
| 5,185,590 | 2/1993 | DiVincenzo | 335/201 |
| 5,185,684 | 2/1993 | Beihoff et al. | 361/45 |
| 5,185,685 | 2/1993 | Tennies et al. | 361/45 |
| 5,185,686 | 2/1993 | Hansen et al. | 361/45 |
| 5,185,687 | 2/1993 | Beihoff et al. | 361/45 |
| 5,206,596 | 4/1993 | Beihoff et al. | 324/536 |
| 5,208,542 | 5/1993 | Tennies et al. | 324/544 |
| 5,210,517 | 5/1993 | Abe | 338/22 R |
| 5,223,682 | 6/1993 | Pham et al. | 200/148 R |
| 5,224,006 | 6/1993 | MacKenzie et al. | 361/45 |
| 5,227,946 | 7/1993 | Jacobs et al. | 361/106 |
| 5,229,730 | 7/1993 | Legatti et al. | 335/18 |
| 5,245,302 | 9/1993 | Brune et al. | 335/35 |
| 5,245,498 | 9/1993 | Uchida et al. | 361/47 |
| 5,247,276 | 9/1993 | Yamazaki | 338/22 R |
| 5,250,918 | 10/1993 | Edds et al. | 335/35 |
| 5,260,848 | 11/1993 | Childers | 361/127 |
| 5,268,661 | 12/1993 | Grunert et al. | 335/16 |
| 5,293,297 | 3/1994 | Desai | 361/106 |
| 5,296,996 | 3/1994 | Hansson et al. | 361/24 |
| 5,299,730 | 4/1994 | Pasch et al. | 228/180.22 |
| 5,303,113 | 4/1994 | Goleman et al. | 361/93 |
| 5,303,115 | 4/1994 | Nayar et al. | 361/106 |
| 5,307,230 | 4/1994 | MacKenzie | 361/96 |
| 5,313,180 | 5/1994 | Vial et al. | 335/16 |
| 5,313,184 | 5/1994 | Greuter et al. | 338/21 |
| 5,359,293 | 10/1994 | Boksiner et al. | 324/544 |
| 5,373,273 | 12/1994 | Guery et al. | 335/201 |
| 5,382,938 | 1/1995 | Hansson et al. | 338/22 R |
| 5,414,403 | 5/1995 | Greuter et al. | 338/22 R |
| 5,416,462 | 5/1995 | Demarmels et al. | 338/22 R |
| 5,418,463 | 5/1995 | Fleming et al. | 324/520 |
| 5,420,740 | 5/1995 | MacKenzie et al. | 361/45 |
| 5,424,503 | 6/1995 | Neveu | 218/63 |
| 5,426,406 | 6/1995 | Morris et al. | 335/202 |
| 5,428,195 | 6/1995 | Arnold | 218/1 |
| 5,432,140 | 7/1995 | Sumpter et al. | 502/167 |
| 5,432,455 | 7/1995 | Blades | 324/536 |
| 5,434,509 | 7/1995 | Blades | 324/536 |
| 5,436,274 | 7/1995 | Sumpter et al. | 521/88 |
| 5,451,919 | 9/1995 | Chu et al. | 338/22 R |
| 5,452,223 | 9/1995 | Zuercher et al. | 364/483 |
| 5,453,723 | 9/1995 | Fello et al. | 335/18 |
| 5,459,630 | 10/1995 | MacKenzie et al. | 361/45 |
| 5,471,035 | 11/1995 | Holmes | 219/505 |
| 5,471,185 | 11/1995 | Shea et al. | 335/51 |
| 5,473,495 | 12/1995 | Bauer | 361/11 |
| 5,475,609 | 12/1995 | Apothaker | 364/492 |
| 5,483,211 | 1/1996 | Carrodus et al. | 335/18 |
| 5,485,093 | 1/1996 | Russell et al. | 324/522 |

5,493,278 2/1996 MacKenzie et al. ..... 340/638
5,495,083 2/1996 Aymami-Pala et al. ..... 218/1
5,506,789 4/1996 Russell et al. ..... 364/492
5,510,946 4/1996 Franklin ..... 361/56
5,510,949 4/1996 Innes ..... 361/93
5,512,832 4/1996 Russell et al. ..... 324/522
5,519,561 5/1996 Mrenna et al. ..... 361/105
5,530,613 6/1996 Bauer et al. ..... 361/58
5,539,370 7/1996 Arnold ..... 337/8
5,545,679 8/1996 Bollinger, Jr. et al. ..... 523/512
5,546,266 8/1996 MacKenzie et al. ..... 361/93
5,550,751 8/1996 Russell ..... 364/492
5,561,605 10/1996 Zuercher et al. ..... 364/483
5,565,826 10/1996 Karlstrom ..... 335/16
5,578,931 11/1996 Russell et al. ..... 324/536
5,581,192 12/1996 Shea et al. ..... 324/722
5,583,732 12/1996 Seymour et al. ..... 361/93
5,590,012 12/1996 Dollar, II ..... 361/113
5,600,526 2/1997 Russell et al. ..... 361/65
5,602,520 2/1997 Baiatu et al. ..... 338/22 R
5,614,878 3/1997 Patrick et al. ..... 335/14
5,614,881 3/1997 Duggal et al. ..... 338/22
5,615,075 3/1997 Kim ..... 361/87
5,629,824 5/1997 Rankin et al. ..... 361/57
5,644,283 7/1997 Grosse-Wilde et al. ..... 338/20
5,659,453 8/1997 Russell et al. ..... 361/93
5,667,711 9/1997 Mody et al. ..... 219/505
5,694,101 12/1997 Lavelle et al. ..... 335/172
5,706,154 1/1998 Seymour ..... 361/42
5,731,561 3/1998 Manthe et al. ..... 218/35
5,818,671 10/1998 Seymour et al. ..... 361/42
5,831,500 11/1998 Turner et al. ..... 335/17

CIRCUIT BREAKER WITH IMPROVED ARC INTERRUPTION FUNCTION

BACKGROUND OF THE INVENTION

U.S. patent application Ser. No. 06/610,947 filed May 16, 1984 entitled "Solid State Current Limiting Circuit Interrupter" in the name of E. K. Howell discloses the use of semiconductor elements in combination with circuit interrupting contacts to allow the contacts to separate without the occurrence of an arc between the contacts. In the Howell application, which is incorporated herein for purposes of reference, a transistor element is employed in combination with a voltage dependent resistor to transfer the current away from the separating contacts to the transistor and thence from the transistor to the voltage dependent resistor. Some means is required for switching the transistor between conductive and non-conductive states in order for the transistor to be conductive when the contacts are first opened and for the transistor to become non-conductive shortly after contact separation. The Howell application advantageously employs a saturable core current transformer for switching the power transistor on and off within predetermined time intervals. It has since been determined that the same function which the transistor performs can be accomplished by means of a resistor fabricated from a positive temperature coefficient material (PTC) having a relatively low resistance value at low temperatures and a substantially higher resistance at a predetermined higher temperature.

U.S. Pat. Nos. 4,329,726 and 4,413,301 to L. M. Middleman et al. disclose PTC materials operational in the range of 5 to 100 amperes which are employed in series with separable contacts in order to provide circuit protection by the increased series resistance within the circuit when the PTC material carries current higher than a predetermined value.

The use of a material having a negative temperature coefficient within circuit interrupting devices is disclosed within U.S. Pat. No. 4,019,097 entitled "Circuit Breaker with Solid State Passive Overcurrent Sensing Device." This patent teaches the use of a material such as vanadium dioxide or lanthanum cobalt oxide in series with a flux transfer trip mechanism. The thermal response properties of the aforementioned materials are used to sense the presence of an overcurrent condition and to allow the current through a trip mechanism to increase to an operational value. All the aforementioned patents are incorporated herein for purposes of reference. The materials described within the patents to Middleman et al. are incapable of carrying sufficient current to provide overcurrent protection in a circuit such as protected by a molded case circuit breaker.

U.S. Pat. No. 4,583,146 entitled "Fault Current Interrupter" describes a parallel combination of a PTC resistor and a voltage dependent resistor connected across a pair of separable contacts to effectuate fault current interruption without damaging or destroying the PTC resistor.

U.S. Pat. No. 5,614,881 entitled "Current Limiting Device" describes a polymeric current limiting element that is not dependent on a positive temperature coefficient of resistance (PTCR) characteristic, and is herein incorporated by reference.

U.S. patent application Ser. No. 08/797,151 filed Feb. 10, 1997 entitled "Current Suppressing Circuit Breaker Unit for Inductive Motor Protection" describes the aforementioned polymeric current limiting element employed in conjunction with a molded case circuit breaker to rapidly suppress and extinguish high short circuit currents.

U.S. patent application Ser. No. 08/797,152 filed Feb. 10, 1997 entitled "Circuit Breaker Current Limiting Arc Runner" describes the aforementioned polymeric current limiting element employed in a circuit breaker arc runner to rapidly suppress high short circuit currents without heating up during quiescent operating conditions.

U.S. patent application Ser. No. 08/932,486 filed Sep. 18, 1997 entitled "Current Limiting Circuit Breaker with Current Commutation" describes the aforementioned polymeric current limiting element electrically connected in parallel with one of two pairs of separable contacts of a rotary breaker for rapid commutation of the short circuit current into the current limiter.

The purpose of the instant invention is to provide a fault current interrupter employing polymer current limiters, not dependent on PTCR characteristics, within circuits capable of interrupting current within residential and industrial power buses without damaging or destroying the polymer current limiter in the process.

SUMMARY OF THE INVENTION

Fault current interruption circuits capable of repeatedly interrupting fault currents within certain molded case circuit breaker ratings are made possible by the arrangement of a polymer current limiter (PCL) and a voltage dependent resistor (VDR) in parallel with a pair of mechanically switched contacts. Upon separation of the contacts, the current first transfers through the PCL having an initially low resistance. The passage of current through the PCL causes the resistance of the PCL to increase by several orders of magnitude in a manner described in the aforementioned U.S. Pat. No. 5,614,881. The voltage across the PCL and the VDR, in parallel, rapidly increases to the clamping voltage of the VDR, turning on the VDR and transferring the current thereto. Since the voltage across the VDR is substantially higher than supply voltage, the current then rapidly drops to a low value, allowing a pair of auxiliary contacts to complete the interruption process.

DESCRIPTION OF THE PREFERRED EMBODIMENT

Although the use of a PCL as a series or parallel element to a pair of separable contacts in circuit interruption devices is known, the use of such a material as a parallel circuit element for transferring current away from separating contacts to a voltage dependent resistor for eliminating arc occurrence between the contacts has not heretofore been disclosed.

While various materials may be used in PCL devices, each providing unique characteristics, nickel-filled epoxy systems have been shown to be suitable for high short circuit current interruption. Other material systems for PCL devices are described in the aforementioned U.S. Pat. No. 5,614,881.

Figure 1:
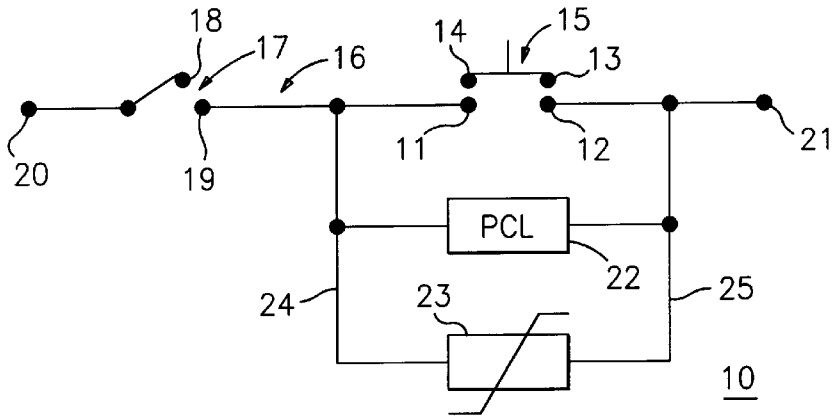
FIG. 1 is a circuit diagram of a circuit interruption arrangement according to the invention.

One such fault current interrupter using a PCL is shown in FIG. 1. The fault current interrupter 10 is connected across a main contact assembly 15 consisting of fixed contacts 11, 12 and bridging contacts 13, 14 which are separated upon overload current through a power bus 16.

The current through the power bus is sensed by means of a current transformer arranged with its primary winding comprising the power bus and with its secondary winding connected with an operating mechanism to rapidly open the contact assembly 15 when the current reaches a predetermined value. The use of one such current transformer and operating mechanism within a protected circuit is described, for example, in U.S. Pat. No. 4,115,829 to E. K. Howell and U.S. Pat. No. 4,001,742 to C. L. Jencks et al. and reference should be made to these patents for a detailed description. The fault current interrupter 10 provides a function similar to the solid state current limiting circuit interrupter within the aforementioned E. K. Howell application wherein "arcless interruption" occurs between separable contacts by transferring the current away from the contacts via a solid state switch. An auxiliary contact assembly 17 having a fixed contact 19 and a movable contact 18 can also be employed in combination with the fault current interrupter 10 if so desired, The power bus 16 is connected to a power source by means of line terminal 20 and to an operating load by means of load terminal 21. A PCL 22, which operates in the manner described in aforementioned U.S. Pat. No. 5,614,881, is connected in parallel with the separable contact assembly 15 and with a voltage dependent resistor, hereafter VDR, such as a metal oxide varistor 23, hereafter MOV, by means of lines 24 and 25.

Figure 3:
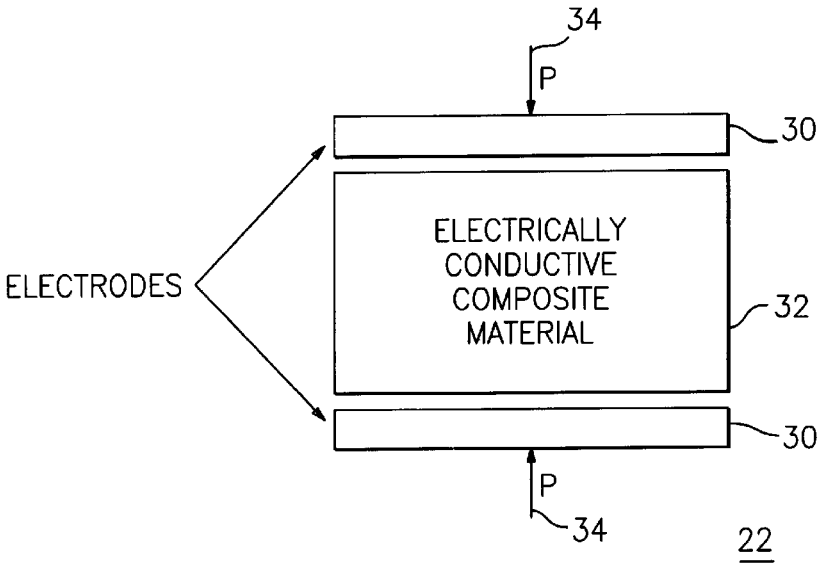
FIG. 3 is a diagrammatic representation of a polymer current limiter according to certain embodiments of the present invention.

The present invention as shown in FIG. 1 employs PCL 22 connected in parallel with separable contact assembly 15 and with a VDR such as MOV 23. Referring now to FIG. 3, PCL 22 includes a pair of electrodes 30 operatively positioned relative to a composite material 32. Composite material 32 comprises a low pyrolysis or vaporization temperature binder and an electrically conducting filler combined with inhomogeneous distributions of resistance structure and under compressive pressure P represented by arrows 34. Composite material 32 is selected to exhibit no PTC effect.

The binder should be chosen such that significant gas evolution occurs at low (<800° C.) temperature. The inhomogeneous distribution structure is typically chosen so that at least one selected thin layer of the composite material 32 within PCL 22 has much higher resistance than the rest of the composite material 32 within PCL 22. This thin layer can be at the interface between the electrodes and the composite material 32.

While not wishing to be bound by theory, it is believed that the advantageous results of the invention are obtained because, during a short-circuit, adiabatic resistive heating of this selected thin layer within composite material 32 followed by rapid thermal expansion and gas evolution from the binding material of composite material 32 leads to a partial or complete physical separation of the composite material 32 at the selected thin layer which produces a higher over-all device resistance to electric current flow. Thus PCL 22 limits the flow of current through the short-circuited current path. When the short-circuit is cleared, by external means, it is believed that PCL 22 regains its low resistance state due to the compressive pressure (represented schematically by arrows 34) built into PCL 22 allowing thereby electrical current to flow normally. PCL 22 used within the present invention is reusable for many such short circuit conditions, depending upon such factors, among others, as the severity and duration of each short circuit.

In accordance with one embodiment of the present invention, a PCL 22 is constructed using an electrically conductive composite material 32 so that there is an inhomogeneous distribution of resistance throughout the device. For this device to work properly as a reusable PCL, the inhomogeneous resistance distribution should be arranged so that at least one thin layer of the PCL 22, or composite material 32, is positioned perpendicular to the direction of current flow and has a much higher resistance than the average resistance for an average layer of the same size and orientation in the device. In addition, PCL 22 must be under compressive pressure in a direction perpendicular to the selected thin high resistance layer, generally denoted by arrows 34. The compressive pressure may be exerted by a structure suitably arranged to exert pressure in the direction shown by arrows 34.

One example of a PCL, in accordance with the present invention, comprises a highly conducting composite material 32 with low pyrolysis temperature binder and conducting filler that is pressure contacted to electrodes 30 so that there is a significant contact resistance between the material 32 and one or both electrodes 30. In operation, PCL 22 is placed in parallel with separable contact assembly 15 and with a VDR such as MOV 23. During normal operation, the resistance of PCL 22 is low (in this example the resistance of PCL 22 would be equal to the resistance of the highly conducting composite material 32 plus the resistance of the electrodes 30 plus the contact resistance). When a short-circuit occurs, a high current density starts to flow through the PCL 22. In the initial stages of the short-circuit, the resistive heating of PCL 22 is believed to be adiabatic. Thus, it is believed that the selected thin, more resistive layer of the PCL 22 heats up much faster than the rest of the PCL 22. Thus, it is believed that the selected thin, more resistive layer of the composite material 32 heats up much faster than the rest of PCL 22. With a properly designed thin layer, it is believed that the thin layer heats up so quickly that thermal expansion of and/or gas evolution from the thin layer cause a separation within the PCL 22 at the thin layer within composite material 32.

In a representative PCL, it is believed that the vaporization and/or ablation of the composite material 32 causes the electrode 30 to separate from the material. In this separated state, it is believed that ablation of the composite material 32 occurs and arcing between the separated layers of the PCL can occur. However, the overall resistance in the separated state is much higher than in the nonseparated state. This high arc resistance is believed due to the high pressure generated at the interface by the gas evolution from the composite binder combined with the deionizing properties of the gas. In any event, the PCL used within the present invention is effective in limiting the short-circuited current so that the other components of the circuit are not harmed by the short circuit.

After the short-circuited current is interrupted, it is believed that the PCL 22 of the present invention, when properly designed, returns or reforms into its nonseparated state due to compressive pressure represented by arrows 34 which acts to push the separated layers (i.e., electrodes 30 and composite material 32) together. It is believed that once the layers of PCL 22 have returned to the nonseparated state or the low resistance state, PCL 22 is fully operational for future current-limiting operations in response to other short-circuit conditions.

It should be apparent to those skilled in the art that the PCL employed within the present invention works more than once (as opposed to a fuse); is triggered by heating at the interface due to contact resistance; requires a low pyrolysis/decomposition/ablation temperature binder (<800° C.) such as an organic binder with electrically conducting filler; is combined with metal and/or semiconductor electrodes under pressure; does not require that the material 32 exhibit PTCR effect; limits AC and DC voltage/current waveforms; has been tested to voltages up to 500 V (presently unclear what upper limit may be); and has electrodes 30 which can be integrally attached or simply pressure contacted to the material.

EXAMPLE 1

Various examples of the PCL have been constructed and tested. In one exemplary embodiment, a PCL was constructed according to the schematic representation in FIG. 3 wherein the electrically conductive composite material 32 comprised an elastomer, specifically silicone, as the binder material and a metal, specifically silver, as the filler material and had a resistivity of about 0.004 ohm-cm. The silver-filled curable silicone material (elastomer) was made by mixing two parts, A & B. The A part comprised a vinyl silicone organopolysiloxane fluid having terminal dimethylvinylsiloxy units and dimethylsiloxy units with a viscosity of 400 cps at 25° C. (23 g), the following silver particles from Ames Goldsmith Corp. Ag 4300 (46.6 g), Ag 1036 (37.3 g) and Ag 1024 (37.3 g), and a silicone hydride siloxane fluid having terminal trimethyl siloxy units to provide a fluid with about 0.8% by weight chemically combined hydrogen attached to silicon (1 g). The B part comprised the vinyl silicone organopolysiloxane fluid having terminal dimethylvinylsiloxy units and dimethylsiloxy units with a viscosity of 400 cps (2 g), dimethyl maleate (14 $\mu$L) and Karstedt's platinum catalyst (83 $\mu$L of a 5% platinum solution in xylene) [for details see U.S. Pat. No. 3,775,452, B. D. Karstedt (1973)]. The A component (40 g) and B component (0.44 g) were mixed and then poured into a mold and then cured in a Carver press at 150° C., 30 minutes at 5000 pounds pressure.

The electrodes 30 were made up of copper electroplated with nickel and were pressure contacted to the composite material 32. It should be noted that neither the electrically conductive composite material 32 nor the material of electrodes 30 exhibit any PTCR switching effect. The electrodes 30 were about ¼ inch in diameter and were centered on the material 32 which had about a ¾ inch diameter and a thickness dimension of about ⅛ inch. Pressure was applied by placing a force of about 3.7 kg in the direction represented by arrows 34 across the electrodes 30 which resulted in a pressure of about 170 PSI. The exemplary PCL acted as a simple resistor with a resistance of about 0.06 ohm when less than about 30 A of current was applied through the PCL.

A voltage pulse was utilized to simulate a short-circuit condition. For about the first millisecond, the voltage is about 2.5 V simulating normal circuit operation. The voltage then was raised to about 100 V for about 3 milliseconds to simulate a short-circuit condition. As the voltage pulse is applied, the current through the PCL increased to a maximum peak of about 190 A when the voltage pulse reaches about 100 V. The current then suddenly dropped to a low value of about 1 A, then remained at that low value for the duration of the pulse. Thus, the current was limited from a prospective value of about 1,667 A (100 V/0.06 ohm) to a value of less than 1 A. The voltage was then reduced back to about 2.5 V in about 4 milliseconds simulating the correction of the short-circuit. The resistance of PCL 22 switched by a factor of greater than 3,000 from approximately 0.06 ohms to about 180 ohms when the about 100 V pulse hits the sample PCL. After the completion of this pulse test, the PCL resistance returned to its initial value of about 0.06 ohms (measured using a 30 A current probe). The current limiting device was thus ready for further current limiting operations. In fact, the PCL was put through three more current-limiting operations without any type of failure and, based upon the low level of damage to both the material and the electrodes, there appears to be no reason to believe that the PCL could not have worked many more times.

This simulation is depicted graphically at FIGS. 2–5 of the aforementioned U.S. Pat. No. 5,614,881.

EXAMPLE 2

Another example of a PCL that may be employed within the present invention utilizes the PCL structure shown in FIG. 3 with composite material 32 comprising a thermoset binder, specifically an epoxy binder (Epoxy-Technology Inc. N30 material) and a metal, specifically nickel powder, as the conducting filler material. This material has a resistivity of about 0.02–0.03 ohm-cm and does not exhibit a PTCR effect.

Physically, the devices used in these examples had nickel-electroplated copper electrodes 30 that were about ¼ inch in diameter and were centered on the material 32 which had a ¾ inch diameter and a thickness of about ⅛ inch. Pressure was applied in the direction represented by arrows 34 by placing a force of about 8.2 kg across the electrodes 30 resulting in a pressure of about 370 PSI. The sample PCL acted as a simple resistor with a resistance of about 0.1 ohm when less than 30 A of current was applied through the PCL.

A voltage pulse of approximately 500 V was applied across the device. At the onset of the applied voltage pulse, the current rose to about 200 A and then maintained that value for about 1.2 milliseconds. This initial current value of about 200 A was limited by the output capability of the voltage pulsing apparatus used in this test. Due to this instrumental limitation, the voltage did not reach 500 V during this initial 1.2 milliseconds. However, during this initial 1.2 milliseconds the voltage across the PCL rose as the device transitions into its high resistance state. After 1.2 milliseconds, the current has been forced down to values below about 50 A by the action of the PCL as the PCL reaches its high resistance state and the full 500 V was measured across the PCL.

The current remained at a level below about 50 A until the voltage across the PCL was terminated at 14 milliseconds. The resistance of the PCL was obtained by dividing the voltage waveform data by the current waveform data. At the beginning of the voltage pulse the resistance was about 0.1 ohm and the resistance rose to values greater than about 10 ohm after about 1.2 milliseconds. This high resistance state was maintained until the voltage pulse terminated at 14 milliseconds. It was verified that the current limiting device regained its initial low resistance value of 0.1 A under low current (<30 A) conditions. The test sequence was repeated successfully with the same device for a total of three operations with 500 V short-circuit simulation voltage pulses in order to prove that this PCL could perform as a reusable current limiter.

This example is further described and depicted graphically in the aforementioned U.S. Pat. No. 5,614,881 (FIGS. 6–7).

EXAMPLE 3

As described above with reference to exemplary embodiments and test results, the PCL employed within this invention can effectively limit the current during a short circuit in a direct current (DC) circuit without the use of material having the PTCR effect. It has also been determined that the PCL employed within the present invention can be used as a reusable current-limiter for alternating current (AC) circuits.

An experiment was conducted using the same PCL as described with reference to Example 2. The initial resistance of the current limiting device, probed with a low current (<30 A) pulse, was about 0.1 ohm.

A 60 Hz AC voltage pulse with about 370 V amplitude and about 150 milliseconds time duration was applied to the PCL. The AC pulse was applied with a closing phase angle of approximately 120 degrees for approximately 40 milliseconds. The current increased to a value of approximately +100 A, then decreased and crossed 0 A as the voltage crossed 0 V and then increased in magnitude to a value of approximately 100 A. The current magnitude was then forced down to a level of less than about 2 A by the action of the PCL even as the voltage magnitude continued to rise. The current magnitude then remained at a level of less than about 2 A as the AC voltage continued to oscillate between +370 and −370 V for approximately 195 milliseconds when the AC voltage pulse was terminated. Thus, the PCL attained a high resistance state with a greater than 185 ohm resistance value.

This example is further described and depicted graphically in the aforementioned U.S. Pat. No. 5,614,881 (FIG. 8).

After this demonstration of the current limiting characteristics, it was verified that the PCL regained its initial low resistance value of about 0.1 A under low current (<30 A) conditions. This test sequence was repeated successfully a second time with the same 370 V AC voltage pulse in order to prove that this device could perform as a reusable PCL.

It should be apparent to those skilled in the art that the PCLs employed within the embodiments of the present invention work more than once (as opposed to a fuse); are triggered by heating at the interface due to contact resistance; require a low pyrolysis/decomposition/ablation temperature binder (<800° C.) such as organic binder with electrically conducting filler; are combined with metal and/or semiconductor electrodes under pressure; do not require that the material exhibit PTCR effect; limit AC and DC voltage/current waveforms; have been tested to voltages up to 500 V (presently unclear what upper limit may be); and have electrodes which can be integrally attached or simply pressure contacted to the material.

Additional examples representing experiments actually conducted are provided. These examples utilize various binder materials, conducting filler materials, third phase filler materials, if appropriate, and electrode materials and were all successful in that the simulated short circuit current was limited in the same manner as described above. The following experiments were all conducted utilizing the basic PCL configuration of FIG. 3; however, it should be noted that the present invention is not limited to the single composite material, two electrode version shown in FIG. 3 but could include multiple composite material and more than two electrodes.

EXAMPLE 4

A thermoset binder, specifically, an epoxy binder with a metal filler, specifically silver, as the conducting filler was prepared using the following silver particles from Ames Goldsmith Corp. Ag 4300 (5.6 g), Ag 1036 (4.2 g), Ag 1024 (4.2 g) and a two component commercial epoxy (Epotek 301) obtained from Epoxy Technology Inc. The epoxy resin (2.3 g) was mixed with the hardener (0.6 g) and then the silver particles were added and the mixture was placed in a Teflon RTM mold and cured at 60° C. for 1 hour. The electrodes were made of Ni-coated Cu.

EXAMPLE 5

A thermoset binder, specifically an epoxy binder with a metal, specifically Silver, as the conducting filler was prepared using Ablebond RTM 967-1 (Commercial Conducting Adhesive Material from Ablestik Electronic Materials & Adhesives (a subsidiary of National Starch and Chemical Company) was placed in a Teflon RTM. mold and cured at 80° C. for about 2 hours. The electrodes were made of Ni-coated Cu.

EXAMPLE 6

A thermoset binder, specifically an epoxy binder with a metal, specifically Nickel, as the conducting filler was prepared using Epotek N30 (Commercial Conducting Adhesive Material from Epoxy Technology Inc.) was placed in a Teflon RTM mold and cured at 150° C. for about 1 hour. With this specific electrically conductive composite material, separate PCLs having the electrodes made of Ni-coated Cu, Stainless Steel, Ag-coated Cu and Cu were tested.

EXAMPLE 7

An elastomer binder, specifically a Silicone binder with a two component metal conducting filler, specifically Silver+Aluminum, as the conducting filler was prepared by mixing two parts, A & B. The A part comprised a vinyl silicone organopolysiloxane fluid having terminal dimethylvinylsiloxy units and dimethylsiloxy units (400 cps, 23 g), 37.3 g of aluminum powder, the following silver particles from Ames Goldsmith Corp. Ag 4300 (46.6 g), Ag 1036 (37.3 g) and Ag 1024 (37.3 g), and a silicone hydride siloxane fluid having terminal trimethyl siloxy units to provide a fluid with about 0.8% by weight chemically combined hydrogen attached to silicon (1 g). The B part comprised vinyl silicone organopolysiloxane fluid having terminal dimethylvinylsiloxy units and dimethylsiloxy units with a viscosity of 400 cps (2 g), dimethyl maleate (14 $\mu$L) and Karstedt's platinum catalyst, mentioned above (83 $\mu$L of a 5% platinum solution in xylene). The A component (40 g) and B component (0.44 g) were mixed and then poured into a mold and then cured in a Carver press at about 150° C. for about 30 minutes at about 5000 pounds pressure. In this example, the electrodes were made of either Ni-coated Cu or an n-type Si (semiconductor).

EXAMPLE 8

An elastomer binder, specifically a Silicone binder, with a metal conducting filler, specifically Silver only, as the conducting filler was prepared by mixing two parts, A & B. The A part comprised a vinyl silicone organopolysiloxane fluid having terminal dimethylvinylsiloxy units and dimethylsiloxy units (400 cps, 23 g), the following silver particles from Ames Goldsmith Corp. Ag 4300 (46.6 g), Ag 1036 (37.3 g) and Ag 1024 (37.3 g), and a silicone hydride siloxane fluid having terminal trimethyl siloxy units to provide a fluid with about 0.8% by weight chemically combined hydrogen attached to silicon (1 g). The B part was comprised the vinyl silicone organopolysiloxane fluid having terminal dimethylvinylsiloxy units and dimethylsiloxy units with a viscosity of 400 cps (2 g), dimethyl maleate (14 $\mu$L) and Karstedt's platinum catalyst, as mentioned above (83 $\mu$L of a 5% platinum solution in xylene). The A component (40 g) and B component (0.44 g) were mixed and then poured into a mold and then cured in a Carver press at 150° C., 30 minutes at 5000 pounds pressure. In this example, the electrodes were made of Ni-coated Cu.

EXAMPLE 9

An elastomer binder, specifically a silver-filled, curable silicone was made from two parts, A & B. The A part comprised a vinyl silicone organopolysiloxane fluid having terminal dimethylvinylsiloxy units and dimethylsiloxy units (400 cps, 33 g), the following silver particles from Ames Goldsmith Corp. Ag 4300 (46.6 g), Ag 1036 (37.3 g) and Ag 1024 (37.3 g), alpha quartz (Minusil, 23 g) and a silicone hydride siloxane fluid having terminal trimethyl siloxy units to provide a fluid with about 0.8% by weight chemically combined hydrogen attached to silicon (2 g). The B part comprised the vinyl silicone organopolysiloxane fluid having terminal dimethylvinylsiloxy units and dimethylsiloxy units with a viscosity of 400 cps (10 g), dimethyl maleate (70 μL) and Karstedt's platinum catalyst, as mentioned above (415 μL of a 5% platinum solution in xylene). The A component (40 g) and B component (0.5 g) were mixed and then poured into a mold and then cured in a Carver press at about 150° C. for about 30 minutes at about 5000 pounds pressure. In this example, the electrodes were made of Ni-coated Cu.

EXAMPLE 10

A reinforced elastomer binder, specifically a curable silicone reinforced with fumed silica, with a two component metal filler, specifically, silver and aluminum was made with an A part and a B part. The A part was composed of an elastomer binder, specifically a vinyl silicone organopolysiloxane fluid having terminal dimethylvinylsiloxy units and dimethylsiloxy units (400 cps, 23 g), a silicone hydride siloxane fluid having terminal trimethyl siloxy units to provide a fluid with about 0.8% by weight chemically combined hydrogen attached to silicon (2 g), doubly treated fumed silica (300 $m^2$ /g, treated with cyclooctamethyltetrasiloxane and with hexamethyldisilazane, 1.2 g), aluminum powder (37.3 g), silver particles from Ames Goldsmith Corp. Ag 4300 (46.6 g), Ag 1036 (37.3 g), Ag 1024 (37.3 g). The B part was composed of the vinyl silicone organopolysiloxane fluid having terminal dimethylvinylsiloxy units and dimethylsiloxy units (400 cps, 2 g), dimethylmaleate (14 .mu.L) and Karstedt's platinum catalyst (83 .mu.L). A curable formulation was prepared by combining the A part (40 g) and the B part (0.44 g) and then hand mixing and placing in a mold. Cure was accomplished in a Carver press at 5000 pounds pressure and 150° C. for 30 min. In this example, the electrodes were made of Ni-coated Cu.

EXAMPLE 11

An elastomer binder, specifically a nickel filled silicone, was made from two parts, A & B. The A part consisted of a vinyl silicone organopolysiloxane fluid having terminal dimethylvinylsiloxy units and dimethylsiloxy units (400 cps, 25 g), nickel powder (INCO type 123, 100 g) and a silicone hydride siloxane fluid having terminal trimethyl siloxy units to provide a fluid with about 0.8% by weight chemically combined hydrogen attached to silicon (2 g). The B part was composed of the vinyl silicone organopolysiloxane fluid having terminal dimethylvinylsiloxy units and dimethylsiloxy units with a viscosity of 400 cps (10 g), dimethyl maleate (70 μL) and Karstedt's platinum catalyst (415 μL of a 5% platinum solution in xylene). The A component (40 g) and B component (0.5 g) were mixed and then poured into a mold and then cured in a Carver press at 150° C., 30 minutes at 5000 pounds pressure. In this example, the electrodes were made of Ni-coated Cu.

EXAMPLE 12

A thermoplastic binder, specifically polytetrafluoroethylene binder, with a semiconductor conducting filler, specifically Carbon Black was commercially obtained. Specifically, GS-2100-080-5000-SC (Commercial Conductive Fluoropolymer from W. L. Gore & Associates, Inc.) was utilized with electrodes made of Ni-coated Cu.

EXAMPLE 13

Finally, a thermoplastic binder, specifically Poly(ethylene glycol) with a metal filler, specifically Silver, as the conducting filler was made. A silver particle mixture comprising the following particles from Ames Goldsmith Corp., Ag 4300 (2.8 g), Ag 1036 (2.1 g), Ag 1024 (2.1 g) was heated to about 80° C. and then poured into molten Poly (ethyleneglycol) (MW8000) at about 80° C. and mixed. The material was then poured into a Teflon.RTM. mold and allowed to harden at room temperature. In this example, the electrodes were made of Ni-coated Cu.

For the above exemplary examples, when tested as a current limiter, the electrodes were pressed against the electrically conductive composite material at pressures ranging from about six (6) to about three hundred seventy (370) PSi. Specifically, the pressure used in examples 4, 5, 7, 8 and 12 was about 170 PSI; examples 6, 9 and 11 was about 370 PSI; and examples 10 and 13 was about 6 PSI. While the above pressure range was actually tested, it may be possible that the device of the present invention will perform properly at higher or lower pressures.

From the above, it is clear that a binder material having a low pyrolysis or vaporization temperature (<800° C.) such as: a thermoplastic (for example, polytetrafluoroethylene, poly(ethyleneglycol), polyethylene, polycarbonate, polyimide, polyamide, polymethylmethacrylate, polyester etc.); a thermoset plastic (for example, epoxy, polyester, polyurethane, phenolic, alkyd); an elastomer (for example, silicone (polyorganosiloxane), (poly)urethane, isoprene rubber, neoprene, etc.); an organic or inorganic crystal; combined with an electrically conducting filler such as a metal (for example, nickel, silver, aluminum, copper, etc.) or a semiconductor (for example, carbon black, titanium dioxide, etc.) with a particulate or foam structure; combined with a metal or semiconductor electrode pressure contacted to the electrically conducting composite material, could also perform effectively in the PCL employed by of the present invention.

Third phase fillers could be used to improve specific properties of the composite such as the mechanical properties; dielectric properties; or to provide arc-quenching properties or flame-retardant properties. Materials which could be used as a third phase filler in the composite material include: a filler selected from reinforcing fillers such as fumed silica, or extending fillers such as precipitated silica and mixtures thereof. Other fillers include titanium dioxide, lithopone, zinc oxide, diatomaceous silicate, silica aerogel, iron oxide, diatomaceous earth, calcium carbonate, silazane treated silicas, silicone treated silicas, glass fibers, magnesium oxide, chromic oxide, zirconium oxide, alpha-quartz, calcined clay, carbon, graphite, cork, cotton sodium bicarbonate, boric acid, alumina-hydrate, etc. Other additives may include: impact modifiers for preventing damage to the PCL such as cracking upon sudden impact; flame retardant for preventing flame formation and/or inhibiting flame formation in the PCL; dyes and colorants for providing specific color components in response to customer requirements; UV screens for preventing reduction in component physical properties due to exposure to sunlight or other forms of UV radiation.

In operating the fault current interrupter 10, upon separation of the contact assembly 15, the current immediately transfers through the PCL 22 having a low initial resistance. The current passes through the PCL causing its resistance to rapidly increase in a manner described in the aforementioned U.S. Pat. No. 5,614,881 such that the voltage across the parallel combination of the PCL 22 and the MOV 23 correspondingly increases to the clamping voltage of the MOV causing the current to immediately transfer through the MOV. The voltage, now being substantially higher than the supply voltage, rapidly causes the current through the MOV to drop to a very low value. The MOV can have the composition described within U.S. Pat. No. 4,374,049 in the names of J. Ellis et al. whereby the clamping voltage can be adjusted by varying the composition of the MOV materials as well as the process of fabrication.

Figure 2:
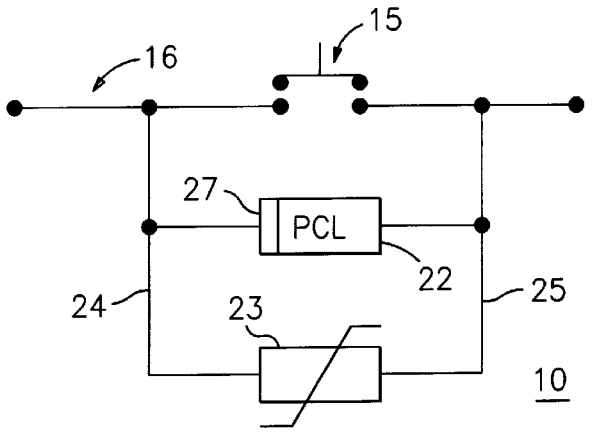
FIG. 2 is a circuit diagram of a further embodiment of the interruption arrangement depicted in FIG. 1.

The electrode interface of the PCL 22 as shown in FIG. 1 (and FIG. 2) reference should be made to aforementioned U.S. Pat. No. 5,614,881 for a detailed description of how the PCL operates, is heated by $I^2Rt$ adiabatic joule heating, where R is the resistance of the PCL electrode interface. When current first transfers to the PCL, R is low, hence the power loss is low and the interface temperature rises slowly. As temperature rises, R increases resulting in higher power loss and faster heating. However, because the power is a function of the square of the current, the heating rate is quite sensitive to current magnitude. The fault current interrupter 10 shown in FIG. 2 is similar to that within FIG. 1 wherein the fault current interrupter is connected across a contact assembly 15 within a power bus 16. The PCL 22 is connected in parallel within the contact assembly and with the MOV 23 by means of lines 24, 25. The PCL 22 has a thin MOV layer 27 fused to one end which exhibits a very low clamping voltage in the order of approximately 5 volts. When the current transfers from the contact assembly 15 to the PCL 22, the heating power within the MOV layer 27 is generated by the product of the voltage across the MOV layer 27 and the current through the MOV layer 27. Alternatively, the fixed voltage drop provided by the MOV layer 27 can be distributed in grain boundaries within the material comprising the PCL 22, or in combination with the MOV layer 27 if more rapid electrode interface heating is desired. Since the initial heating power within the MOV layer 27 is a linear function of current the initial rate of temperature rise in this embodiment is greater and is less sensitive to current magnitude than in the embodiment of FIG. 1. Thereby effecting a greater rate of resistance rise in the PCL, and a greater rate of current transfer into the MOV 23.

When high current composite metal insulator PCLs are arranged such that the conductive metal is encapsulated within a matrix of MOV material to form a PCL-MOV resistor, the separate MOV 23 is no longer required. The metal would provide initial low temperature and low resistance conductive properties to the PCL-MOV resistor to rapidly transfer the current initially away from the contact assembly 15. As the current through the PCL-MOV resistor increases and the electrode-interface temperature increases, the PCL would operate as described in aforementioned U.S. Pat. No. 5,614,881 causing the current upon transfer through the PCL-MOV material to rapidly decrease. Although the fault current interrupter of the instant invention is described for purposes of protecting equipment and wiring within a power bus, this is by way of example only. The fault current interrupter can be used in any situation where "arcless" switching is required such as explosive atmosphere in mines for example, and when "noise-free" switching is required such as with sensitive electronic components within computers.

What is claimed is:

1. A fault current interrupter comprising:

a pair of separable electric contacts arranged for interrupting current flow through an electric circuit;

a polymer current limiter electrically connected in parallel across said electric contacts for transferring said current through said polymer current limiter when said electric contacts become separated, said polymer current limiter comprising:

at least two electrodes, an electrically conducting composite material between said electrodes, said composite material comprising (A) a binder with a pyrolysis or vaporization temperature, at which significant gas evolution occurs, below 800° C., and (B) an electrically conductive filler, interfaces between said electrodes and said composite material, an inhomogeneous distribution of resistance at said interfaces whereby, during a short circuit, adiabatic resistive heating at said interfaces causes rapid thermal expansion and vaporization of said binder resulting in at least a partial physical separation at said interfaces, and a structure for exerting compressive pressure on said composite material; and a resistor electrically connected in parallel across said electrical contacts and said polymer current limiter.

2. The interrupter of claim 1 wherein the composite material has no PTC effect.

3. The interrupter of claim 1 wherein said structure for exerting compressive pressure on said composite material applies compressive pressure perpendicularly to said interfaces.

4. The interrupter of claim 1 wherein said electrodes are pressure contacted to said composite material.

5. The interrupter of claim 1 wherein, the electrically conducting composite material includes:

a thermoplastic.

6. The interrupter of claim 5 wherein, the thermoplastic comprises:

polytetrafluoroethylene.

7. The interrupter of claim 5 wherein, the thermoplastic comprises:

poly(ethyleneglycol).

8. The interrupter of claim 5 wherein, the thermoplastic comprises:

polyethylene.

9. The interrupter of claim 5 wherein, the thermoplastic comprises:

polycarbonate.

10. The interrupter of claim 5 wherein, the thermoplastic comprises:

polyimide.

11. The interrupter of claim 5 wherein, the thermoplastic comprises:

polyamide.

12. The interrupter of claim 5 wherein, the thermoplastic comprises:

polymethylmethacrylate.

13. The interrupter of claim 5 wherein, the thermoplastic comprises:

polyester.

14. The interrupter of claim 1 wherein, the electrically conducting composite material includes:

a thermoset plastic.

15. The interrupter of claim 14 wherein, the thermoset plastic comprises:

epoxy.

16. The interrupter of claim 14 wherein, the thermoset plastic comprises:

polyester.

17. The interrupter of claim 14 wherein, the thermoset comprises:

polyurethane.

18. The interrupter of claim 14 wherein, the thermoset comprises:

phenolic containing resin.

19. The interrupter of claim 14 wherein, the thermoset comprises:

alkyd containing resin.

20. The interrupter of claim 14 wherein, the thermoset comprises:

an elastomer.

21. The interrupter of claim 20 wherein, the elastomer comprises:

silicone.

22. The interrupter of claim 20 wherein the elastomer comprises:

polyurethane.

23. The interrupter of claim 20 wherein the elastomer comprises:

isoprene rubber.

24. The interrupter of claim 20 wherein the elastomer comprises:

neoprene.

25. The interrupter of claim 1 wherein the electrically conducting material includes:

a metal.

26. The interrupter of claim 25 wherein the metal comprises:

nickel.

27. The interrupter of claim 25 wherein the metal comprises:

silver.

28. The interrupter of claim 25 wherein the metal comprises:

aluminum.

29. The interrupter of claim 25 wherein the metal comprises:

copper.

30. The interrupter of claim 1 wherein the electrically conducting composite material includes:

a semiconductor.

31. The interrupter of claim 30 wherein the semiconductor comprises:

carbon black.

32. The interrupter of claim 30 wherein the semiconductor comprises:

titanium dioxide.

33. The interrupter of claim 1 wherein the electrically conducting composite material includes:

a silicone binder filled with silver.

34. The interrupter of claim 1 wherein the electrically conducting composite material includes:

a silicone binder filled with silver and aluminum.

35. The interrupter of claim 1 wherein the electrically conducting composite material includes:

a silicone binder filled with nickel.

36. The interrupter of claim 1 wherein the electrically conducting composite material includes:

an epoxy binder filled with nickel.

37. The interrupter of claim 1 wherein the electrically conducting composite material includes:

an epoxy binder filled with aluminum.

38. The interrupter of claim 1 wherein the electrically conducting composite material includes:

a polytetrafluoroethylene binder filled with carbon black.

39. The interrupter of claim 1 wherein the electrically conducting composite material includes:

a poly(ethyleneglycol) binder filled with silver.

40. The interrupter of claim 1 wherein the electrodes comprise a material selected from the group consisting of:

metals or semiconductors.

41. The interrupter of claim 1 wherein said resistor comprises a material of ohmic resistance characteristics.

42. The interrupter of claim 1 wherein said resistor comprises a material of voltage dependant characteristics.

43. The interrupter of claim 41 wherein said resistor comprises a metal oxide varistor.

44. The interrupter of claim 1 wherein, further comprising a second resistor fused to one of the electrodes of the polymer current limiter.

45. The interrupter of claim 43 wherein the second resistor comprises a material of ohmic resistance characteristics.

46. The interrupter of claim 43 wherein the second resistor comprises a material of voltage dependant characteristics.

47. The interrupter of claim 45 wherein the material of voltage dependant characteristics comprises a metal oxide varistor.

48. The interrupter of claim 46 wherein the metal oxide varistor exhibits a clamping voltage of approximately 5 volts.

* * * * *